United States Patent [19]

Sommer et al.

[11] Patent Number: 4,754,114

[45] Date of Patent: Jun. 28, 1988

[54] INDUCTION HEATER

[75] Inventors: Richard A. Sommer, Warren; Mario Tama, Cortland, both of Ohio; Theodore E. Burke, Volant, Pa.

[73] Assignee: Ajax Magnethermic Corporation, Warren, Ohio

[21] Appl. No.: 813,855

[22] Filed: Dec. 27, 1985

[51] Int. Cl.[4] ..... H05B 6/10

[52] U.S. Cl. ..... 219/10.79; 219/10.67; 219/10.69; 219/10.71

[58] Field of Search ..... 219/10.67, 10.69, 10.71, 219/10.75, 10.79; 336/100

[56] References Cited

U.S. PATENT DOCUMENTS

| | | | |
|---|---|---|---|
| 3,260,974 | 7/1966 | Specht et al. | 336/100 |
| 3,424,886 | 1/1969 | Ross | 219/10.67 |
| 4,532,398 | 7/1985 | Henriksson | 219/10.67 |
| 4,649,249 | 3/1987 | Odor | 219/10.67 |

FOREIGN PATENT DOCUMENTS

| | | |
|---|---|---|
| 81776 | 4/1982 | European Pat. Off. . |
| 839343 | 6/1960 | United Kingdom . |

*Primary Examiner*—A. D. Pellinen
*Assistant Examiner*—L. Fuller
*Attorney, Agent, or Firm*—Fay, Sharpe, Beall, Fagan, Minnich & McKee

[57] ABSTRACT

An induction heater is provided for heating electrically conducting workpieces. The heater comprises an induction coil having a number of turns including long straight conductors wherein a major portion of the long straight conductors are secured to a concrete support beam. The conductors and the support beam vibrate together in response to electromagnetic field forces generated during operation of the heater. The coil is caused to vibrate with the coil support beam by a hard adhesive which bonds the support beam and the coil or by tension members which hold the coil tightly to the support beam.

16 Claims, 3 Drawing Sheets

FIG. 4
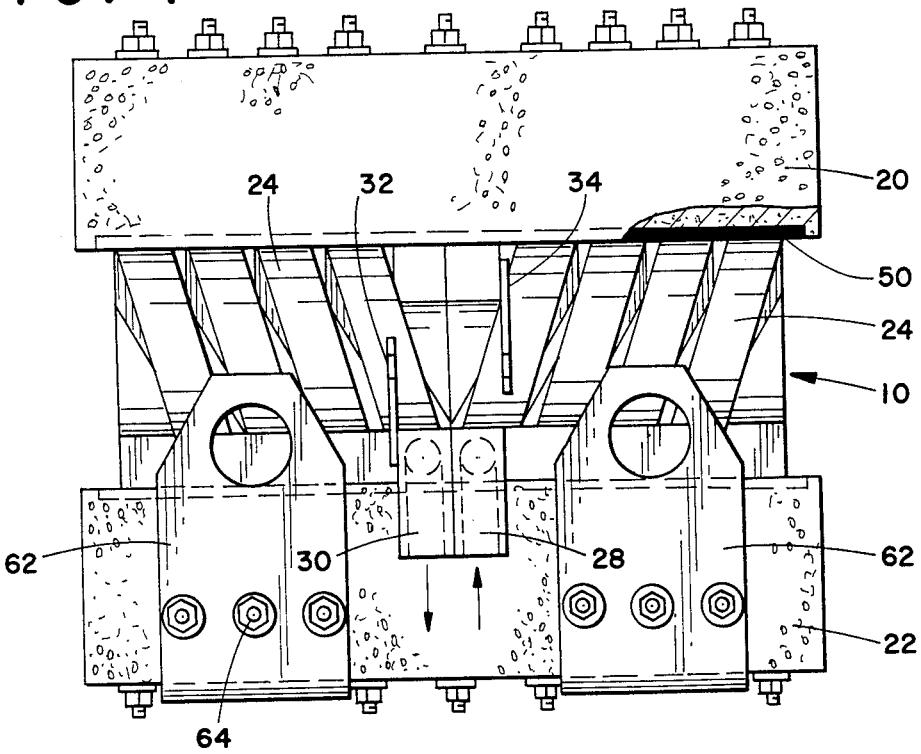
FIG. 6
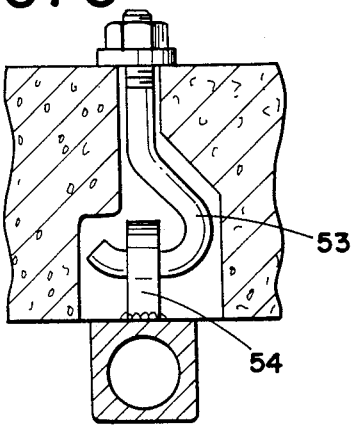
FIG. 7
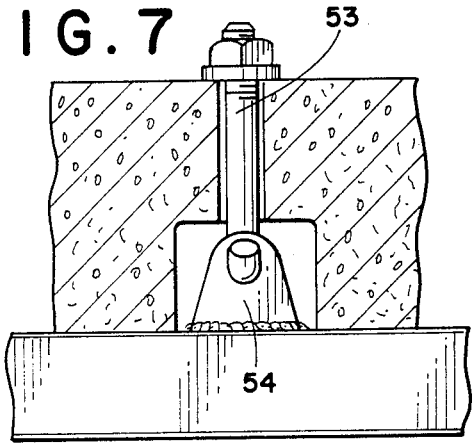
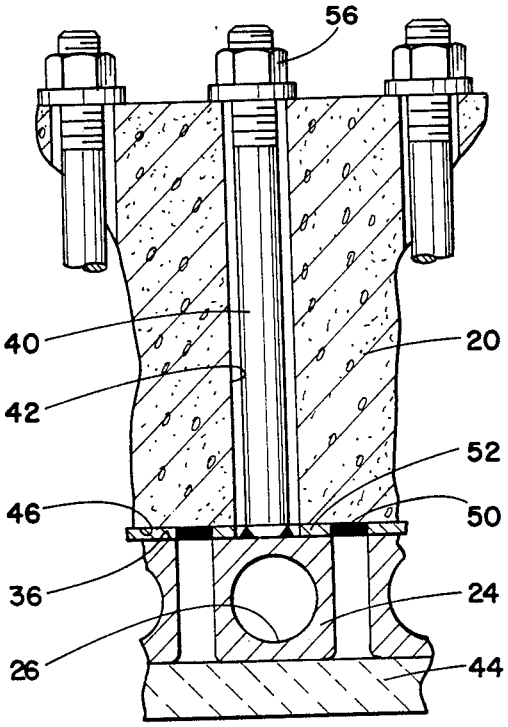
FIG. 5

INDUCTION HEATER

BACKGROUND OF THE INVENTION

This invention pertains to the art of induction heating devices and, more particularly, to an induction heater wherein the forces on the heater coil cause coil vibration and sound generation.

The invention is particularly applicable to a generally rectangular induction heater for heating workpieces including a coil having a number of coil turns where at least a portion of the turns is supported by a concrete beam to reduce the vibration of the coil and, thereby, reduce sound generation. However, it will be appreciated to those skilled in the art that the invention could be readily adapted for use in other environments as, for example, where similar support members are employed to reduce vibration and sound generation with other types of vibrating items.

It is known that when a current-carrying conductor is in a magnetic field, a force is exerted on the conductor. The direction of the force is at right angles to the conductor and to the direction of the field. The magnitude of the force depends upon the magnitude of the current and upon the strength of the magnetic field. In an induction heater, including a coil in which an alternating current is applied to heat a workpiece, an associated alternating force is induced on the coil which produces vibration and consequent sound generation. For example, in a typical 90×24 inch rectangular coil with a conductor current of approximately 4500 amps, the force on the coil is approximately 0.4 lbs. (RMS) per square inch. The sound generated by such a coil force can be in excess of 95 dbA.

The vibration of the coil in an induction heater is a common problem which has several undesirable effects. The vibration will weaken the coil itself since repeated flexing gradually makes the inductor brittle and may ultimately cause cracking. In addition, as noted above, coil vibration generates sound which at a level of 95 dbA may be above the sound regulations for a particular operation, or at least may present an undesirable work environment.

Various forms and types of supports have heretoforce been suggested and employed in the induction heater industry to support a vibrating induction heater coil, all with varying degrees of success. For example, steel beams in combination with laminated support members have been employed (U.S. Pat. No. 3,485,983 to Tama et al.). Although steel beam bracing is functionally efficient, the cost of construction of such a bracing assembly is relatively high and, for economic reasons, other less costly bracing structures are desirable.

Concrete is also known as a relatively cost efficient support casing and refractory material for use in induction heater coils (see U.S. Pat. No. 4,532,398 to Henriksson). However, several problems exist with concrete both in its method of manufacture as an induction heating coil support, and in its ability to withstand the tensile forces generated by the coil during operation. More particularly, concrete typically shrinks when cured and if an induction heater coil is cast in concrete as a support, the shrinking of the concrete during curing may result in discontinuous support of the coil. In heater operation this would allow for microslapping of the coil against the concrete and consequent generation of even higher noise levels. To reduce the effect of the vibrating coil, coil supporting rubber or elastic layers have been interposed between the concrete casing and the coil to absorb the vibrational and expansion forces of the coil. However, a combination of a concrete casting and an elastic layer to support a coil completely fails in reducing the vibration of the coil itself and, thereby, permits the continued existance of the problems resulting from repeated coil flexing and consequent sound generation.

The present invention contemplates a new and improved apparatus which overcomes all of the above-referred to problems and others to provide a new induction heater for heating conductive workpieces which is simple in design, economical to manufacture, readily adaptable to a plurality of uses with workpieces having a variety of dimensional characteristics, is rugged and reliable in its operation, and which provides an improved induction heater in its reduction of coil vibration and sound generation.

BRIEF SUMMARY OF THE INVENTION

In accordance with the present invention, there is provided an induction heater for heating electrically conducting workpieces, comprising an induction coil having a number of coil turns, each coil turn including at least two relatively long straight conductors. The long straight conductors of all the coil turns form at least two groups of straight conductors, all conductors of each such group being oriented substantially in the same plane, also known as one coil side. Substantially all said long straight conductors in each group, or coil side, are rigidly secured to a concrete support beam over substantially their entire length, so that each entire group of long straight conductors and its associated concrete support beam will vibrate in unison.

We have found it essential to the achievement of the objectives of our invention that the conductors and the concrete support beam be rigidly joined in such a manner as to vibrate as one composite beam over their entire length. When thus properly joined, the resulting composite beam will have a mass equal to the sum of the masses of the parts, but it will have a combined flexural stiffness substantially greater than the sum of the flexural stiffnesses of the concrete support beam and the straight conductors. This results in a very substantial reduction of vibratory motion over the entire length of the conductors and a corresponding reduction in sound levels. However, if the mechanical connection between the conductors and concrete support beam allows some relative vibratory motion, or if the spacing material between them has a low modulus of elasticity, such as rubber, then the objective of this invention will not be achieved and the vibratory motion of the conductors and associated sound levels will be substantially as high as they would be without any concrete support beam.

The required rigid connection may be achieved by appropriate mechanical tensioning devices spaced at proper intervals along the length of each conductor. This type of connection will generally be preferred when the dimensions of the induction coil are large and the frequency of the electrical current is low. Alternatively, the required rigid connection is obtained by applying a vibrationally stiff bonding material or adhesive between the conductors and the concrete support beam substantially over the entire length of the conductors. The latter type of connection will usually be favored when the dimensions of the induction coil are small and the electrical frequency is high. Mechanical fastenings may also be used as a supplement to adhesive bonding.

Our invention will be useful in induction coils for heating slabs, plates or sheet, which comprise two parallel long coil sides or groups of long straight conductors, as defined above, and two relatively short sides which are frequently U-shaped, and in that case only two concrete support beams are required, all as shown in the drawings. The invention will also be useful in induction coils comprising four long coil sides forming a square or a rectangle approaching a square, and in that event four concrete support beams will be used. Generally, our invention applies to any induction coil with two or more long sides, which could also form a triangle, hexagon, trapezoid, or other polygon, and one concrete support beam will be applied to each long coil side.

In accordance with the present invention, a method of manufacture is provided for an induction heater comprising the steps of first forming a coil comprised of at least two coil sides, each side including a plurality of relatively long straight conductors preferably arranged to define a generally rectangular shape. The second step comprises forming concrete beams sized for close supporting engagement to the coil sides. Each concrete beam is sized to support the long side wall conductors of each coil side. The third step comprises preparing the surfaces of the conductors and the beam for bonding engagement by cleaning, acid etching, and pre-heating both surfaces. The fourth step comprises applying a coil bonding material to the beam surfaces for adhesive bonding of the conductors to that surface. The coil bonding material preferably comprises an adhesive material which is spread on the concrete surface while the bonding material is in a fluid state. The conductors are then seated into it. The positions of the conductors are precisely set relative to the surfaces of the concrete beams through the use of positioning studs and a plurality of spacers interposed between the conductors and the beam to define the bonding material thickness. The spacers are mounted about a plurality of the studs which extend from the conductors through the support beams. The next step in the method comprises assembling the beam to the conductors by tightening down the studs so that the conductors are positioned from the concrete beam by the preselected uniform average distance determined by the spacers, the vast portion of the conductors being separated from the beam by the layer of bonding material. After the conductors are properly positioned and seated in the bonding material, the assembly is cured whereby the support beam is secured to the conductors to the extent that the conductors and concrete beam will vibrate substantially in unison.

One benefit obtained by the use of the present invention is a rugged and reliable induction heater with reduced coil vibration and sound generation made with a more economical method of manufacture.

Another benefit obtained from the present invention is an induction heater including a concrete beam bonded to the heater coil with relatively vibrationally stiff coil bonding material whereby the mass and stiffness of the coil is effectively increased by the mass and stiffness of the beam to reduce amplitude of vibration during heater operation.

Another benefit obtained from the present invention is an induction heater which reduces the intensity of coil vibration and the probability of conductor fatigue failure.

Other benefits and advantages for the subject new induction heater will become apparent to those skilled in the art upon a reading and understanding of this specification.

BRIEF DESCRIPTION OF THE DRAWINGS

The invention may take physical form in certain parts and arrangements of parts and certain steps and arrangements of steps. The preferred embodiments of which will be described in detail in this specification and illustrated in the accompanying drawings which form a part hereof and wherein:

FIG. 4 is an end elevation view of the heater of FIG. 2;

FIG. 5 is an enlarged, partial cross-sectional view particularly showing the configuration of one portion of the support beam and coil assembly taken along line 5—5 of FIG. 3;

FIG. 6 is an enlarged, cross-sectional view particularly showing an alternative means for fastening the coil support beam to the coil; and, FIG. 7 is an enlarged, cross-sectional view showing the embodiment of FIG. 6 rotated 90°.

DETAILED DESCRIPTION OF THE INVENTION

Figure 1:
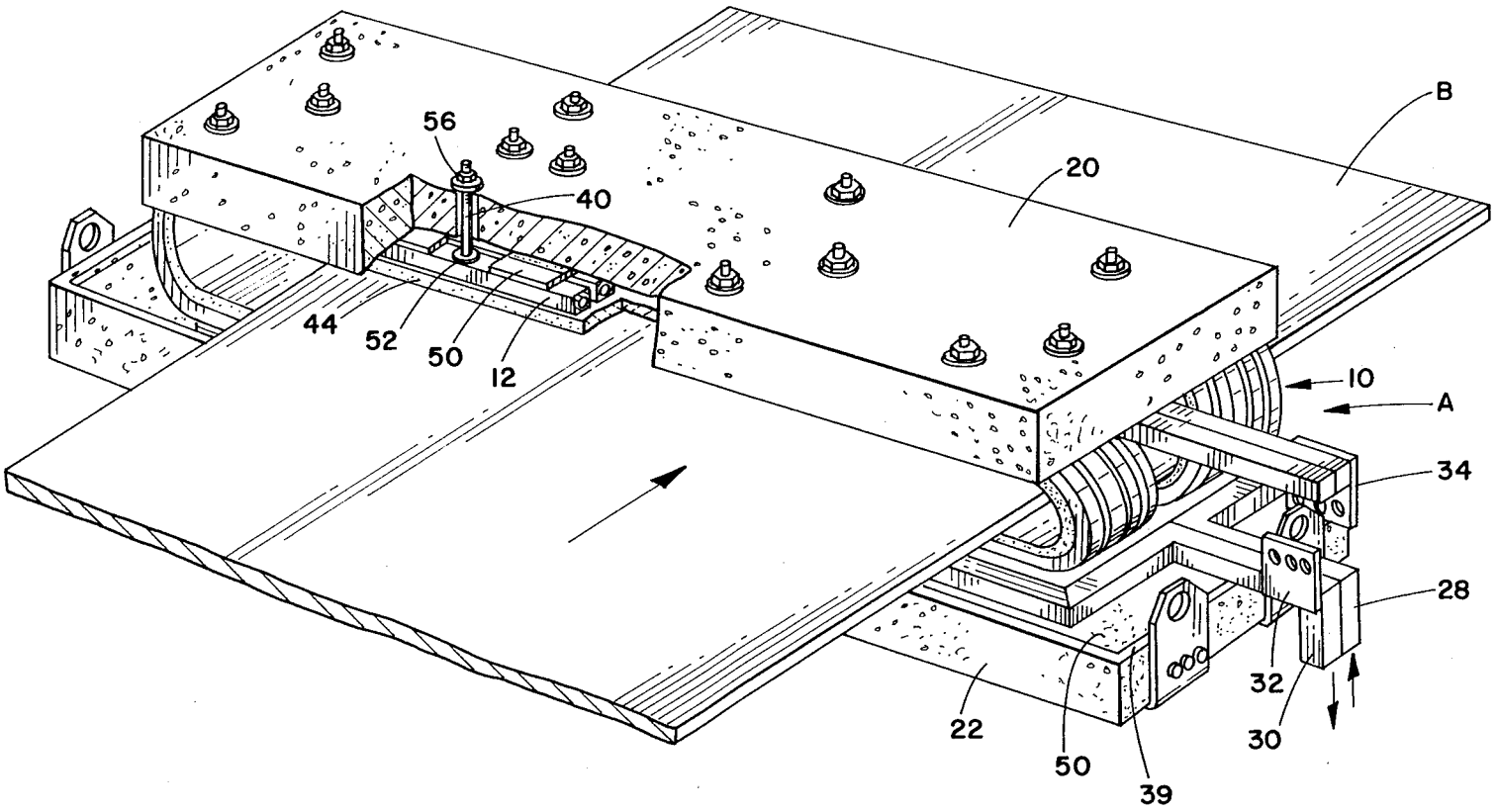
FIG. 1 is a perspective view in partial section of an induction heater formed in accordance with the present invention showing a workpiece in place and passing through the heater.

Referring now to the drawings wherein the showings are for purposes of illustrating the preferred embodiments of the invention only and not for purposes of limiting same, the FIGURES show an induction heater A for heating workpieces such as a slab B.

Figure 2:
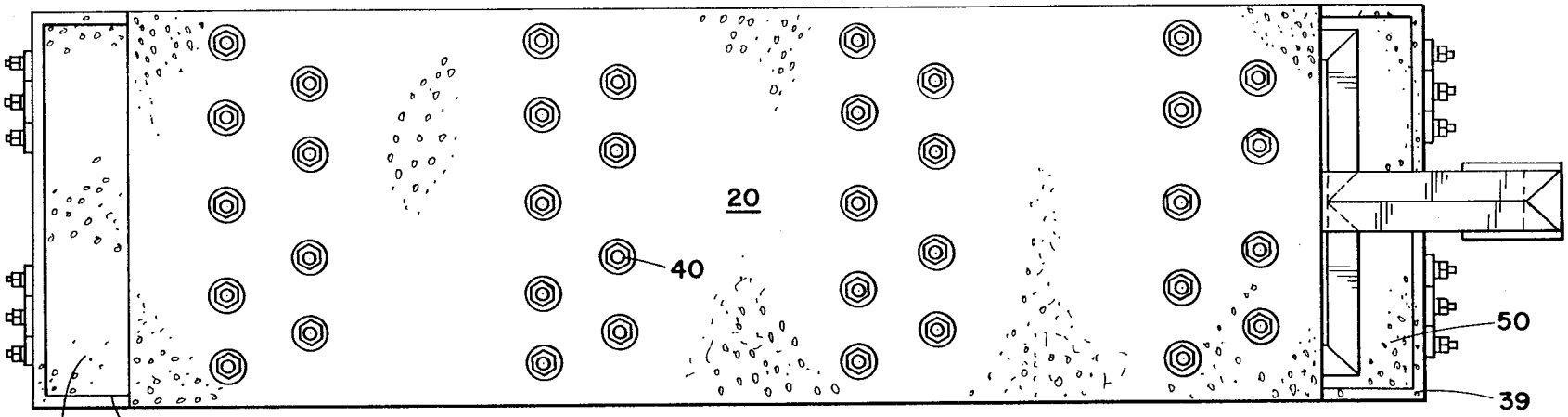
FIG. 2 is a top plan view of the heater of the present invention.
Figure 3:
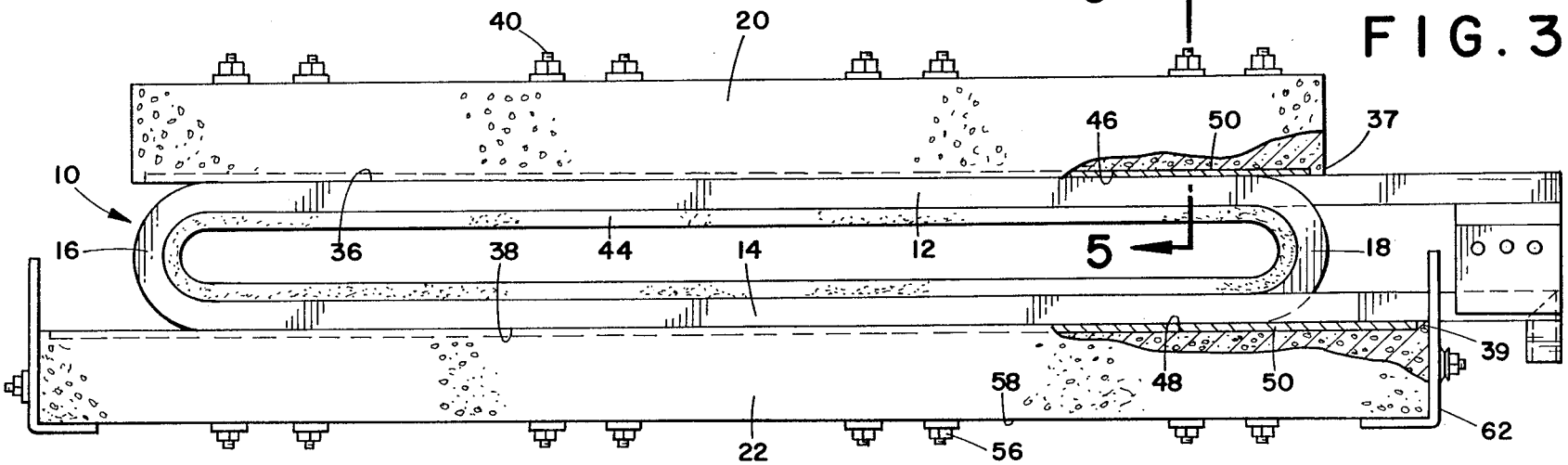
FIG. 3 is a side elevational view showing the heater of FIG. 2 rotated 90°.

More specifically, and with reference to FIGS. 1, 2, and 3, heater A is comprised of a coil 10 having a number of generally rectangular or oval coil turns. Although a rectangular coil is shown in the FIGURES, it is within the scope of the invention to include a variety of coil configurations and dimensions. Each turn of coil 10 has at least two relatively long and straight side wall group of conductors 12, 14 disposed in common planes, respectively, to form first and second coil sides. Two relatively short and generally U-shaped end wall conductors 16, 18 are also included. In alternative embodiments of the invention, the induction coil could comprise four long coil sides forming a square or a rectangle approaching a square. Generally, the invention applies to any induction coil with two or more long sides, which could also form a triangle, hexagon, trapezoid, or other polygon.

Top and bottom concrete slabs or coil support beams 20, 22 are rigidly secured to each long coil side at the long straight conductors 12, 14 such that each group of conductors and their associated support beams will vibrate substantially together. Vibration in unison of the coil support beams and the conductors is produced by the rigid connection of the conductors 12, 14 to the support beams 20, 22. Overall vibration of the conductors is also reduced by the cooperative stiffness of the conductors 12, 14 and the support beams 20, 22 and by the addition of the mass of the support beams to the conductors. If the connection between the conductors and the support beams allows even the slightest relative vibratory motion, such as one thousandth of one inch, then the objective of substantial vibration in unison will not be achieved.

It is known that when a current-carrying conductor is in a magnetic field a force is produced in a direction at right angles to the conductor and the direction of the field. This force is normal to the plane of the workpiece and generally towards support beams 20, 22 during heater operation.

For the purpose of explaining the reduction in the coil vibration due to the mass increase, one should consider that the acceleration of the coil in response to a certain force will be proportional to that force. The force on the coil is generated by the flowing current in the conductors. Since the current is alternating, the force on the coil will pulsate to produce a vibrational acceleration of the conductors 12, 14. The extent of the acceleration, and vibrational movement, will be inversely proportional to the mass of the conductors. For a given force induced during coil operation, in order to reduce the acceleration, one can increase the mass of the conductors. Accordingly, securing the support beams 20, 22 to the conductors 12, 14 effectively increases the mass of the conductors and reduces their acceleration and vibration.

It has been experimentally found that a 90"×24" coil which is loaded with 4500 amps will generate a sound level of 95 dbA. Doubling the mass of the coil will theoretically reduce the sound generation by 6 dbA.

As noted above, the coil 10 can be formed in a variety of configurations; however, the coil typically will be constructed in accordance with the teachings of U.S. Pat. No. 3,424,886 of Ross. In the preferred embodiment illustrated (FIG. 4), the coil includes left and right hand turns and each coil turn 24 has a rectangular cross-sectional area with an inner conduit 26 (FIG. 5) for the communication of a cooling fluid such as water. Fluid inlet and outlet leads 28, 30 are provided for convenient access to fluid lines. Power terminals 32, 34 are also provided for convenient connection to a power source. Although various loads may be applied to the coil 10, the coil will typically handle a current in the range of 4000–10,000 amps.

Securing the support beams 20, 22 to the conductors 12, 14 can be accomplished in a variety of ways. In one embodiment of the invention the coil turns 24 of the conductors include a plurality of radially outwardly directed studs 40 secured to the long side wall conductors 12, 14 by weld or the like. The studs 40 extend through an associated bore 42 in concrete support beams 20, 22. Radially inward of the condutors is an interior liner 44 constructed of refractory insulation which is positioned to insulate the coil 10 against radiation losses from the workpiece B.

The concrete support beams 20, 22 are preformed, cured and dried before attachment to the coil 10. Consequently, the sizes of the beams 20, 22 are fixed before they are secured to the coil conductors and thereby avoid the problems of shrinkage and gaps which have occurred when the coil is cast in concrete. The composition of the beams 20, 22 can be conventional concrete or high strength concrete as the situation may require. The sizes of the beams 20, 22 are selected to generally align with the long side wall conductors 12, 14 in their length and width. The depth of the support beams 20, 22 may vary depending upon the amount of mass which is desired to be added to the conductors to reduce their vibration.

A coil bonding material 50 preferably comprising a hard adhesive vibrationally bonds the concrete beams 20, 22 to the coil side conductors 12, 14. The adhesive 50 is set to be formed in a generally uniform average thickness by a plurality of spacers 52 received about the studs 40. When tightened the studs 40 somewhat assist in setting the spacing between the support beams 20, 22 and the conductors by drawing the conductors 12, 14, support beams 20, 22, adhesive 50 and spacers 52 to a secure assembly. However, after curing of the adhesive 50 the bonding connection is substantially maintained by its adhesive properties while the studs 40 supplement the connection. This type of bonding connection is favored when the dimensions of the induction coil are small and the electrical frequency is high.

With reference to FIGS. 6 and 7, an alternative embodiment of the present invention is illustrated comprising a pivotally connected fastening member such as a hook 53 and eye 54 assembly in place of the studs 40 of the embodiment of FIG. 1. A pivotal connection allows for ease in assembly of the induction heater and is advantageous in larger sized induction heaters where it is more appropriate to employ a mechanical tensioning device such as a hook and eye to maintain the secured connection between the support beams and the coil. An adhesive bonding may not be used in this embodiment. A pure mechanical tensioning connection such as a hook and eye fasteners spaced at proper intervals along the length of the conductors is preferred when the dimensions of the induction coil are large and the frequency of the electrical current is low.

The method of manufacture of the induction heater of the subject invention is comprised of a series of steps. As noted above, the first step comprises forming an induction coil of the desired configuration. In the embodiment illustrated, the induction coil 10 comprises a plurality of spaced coil turns 24 arranged to define a generally rectangular coil. A plurality of studs 40 are secured to the coil conductors 12, 14 and extend radially outwardly from the coil conductors for alignment in concrete beam bores 42 upon assembly of the conductors to the support beams 20, 22. Each concrete beam is sized for close supporting engagement to a major portion of the coil 10 and, preferably, so that the concrete beam generally covers the long side wall conductors 12, 14. Before assembly, the surfaces of the conductors and the support beams 20, 22 are prepared for the bonding engagement with the adhesive 50. The outer side wall portions 36, 38 (FIG. 3) of the long side wall conductors 12, 14 are cleaned and acid etched. Similarly, the concrete beams side walls 46, 48 adjacent the conductors are cleaned and acid etched. In addition, the concrete beam 22 and the coil 10 are heated after they are cleaned and etched to prepare for the spreading of the adhesive 50 for bonding the coil to the beams.

A spacer 52 (FIG. 5) is set about the terminal end of each bore 42 for close reception of stud 40 and to define a spacing between the beam and the conductor. The spacer 52 preferably comprises a washer constructed of a hard insulating material and generally has a diameter equal to the longitudinal cross-sectional dimension of each coil turn 24.

With reference to FIGS. 3 and 5, the adhesive epoxy 50 is spread over the lower beam side wall surface 48 to completely cover the side wall surface at any point that the conductors may contact that surface. A peripheral flange 39 formed in the edge portions of the beam side wall surface 48 contains the adhesive 50 during its liquid state. The adhesive can comprise any relatively vibrationally stiff bonding material which can resiliently deform and bond to both the concrete beams 20, 22 and the conductors 12, 14. Preferably, the bonding material has a modulus of elasticity in excess of 100,000 PSI and a low shrinkage at curing. In one embodiment of the invention, "Scotch Cast 252", an epoxy produced by 3-M Company was successfully employed.

After the spacers 52 and the adhesive 50 have been set on the support beam surface 48, the beam is ready to be bonded to the coil conductors 12, 14. After pre-heating, the conductors 14 are assembled to the beam 22 by lowering the conductors into the bores 42, adhesive 50 and spacers 52. To obtain a generally uniform spacing distance between the conductors 14 and the beam 22, the conductor is positioned against the spacers 52 and adhesive 50 by tightening down the studs 40 at the nuts 56 on the opposite beam side wall surface 58. After such positioning, the conductors are properly seated in the adhesive and the assembly is then cured to bond the conductors 14 to the beam 22 to form a vibrationally stiff connection between the conductors and the beam.

It is desirable to use this method in setting an adhesive thickness to achieve a substantially uniform thickness in continuous opposed engagement to the beams 20, 22 and the coil conductors. Lifting lugs 62 are conveniently mounted at the end portions of the beam for convenience in lifting the assembly for its positioning in an oven and for lowering the lower beam and coil onto the upper beam 20 at its assembly stage.

After the coil conductors 14 have been bonded to the lower beam support, the upper beam side wall surface 46 is similarly prepared by cleaning, acid etching, and pre-heating before receiving the adhesive. The peripheral flange 37 sized to contain the adhesive during a liquid state is included about the terminal edge portions of surface 46 and defines that portion of the surface on which the adhesive is to be spread. The coil 10 and lower beam support 22 are first inverted and then lowered onto the upper beam 20 being aligned by the studs 40 in the bore holes 42. The studs are snugged down so that the beam 20 is fastened to the conductors 12 to properly seat the conductors 12 in the adhesive, and then the second layer of adhesive is cured.

Although threaded studs (FIG. 5) are illustrated in the drawings to precisely seat the conductors 12, 14 in the adhesive, it is within the scope of the invention to use alternate mechanical fastening means such as coil tie-downs or the like to draw the conductors to the support beam to the preselected distance defined by the spacer 52 thicknesses and the spacing desired for the adhesive.

Due to the weight resting on the bottom support beam 22, tensioning rods 64 (FIG. 4) extend through the bottom beam 22 and lifting lug 62 to pre-load the bottom support beam against the tension applied to it by the weight of the assembly.

The invention has been described with reference to the preferred embodiments. Obviously, modifications and alterations will occur to others upon the reading and understanding of the specification. It is our intention to include all such modifications and alterations insofar as they come within the scope of the appended claims or the equivalents thereof.

Having thus described our invention, we now claim:

1. An induction heater for heating electrically conductive workpieces in operation with an alternating current comprising:

an induction coil having a plurality of coil turns, each turn including at least first and second relatively long straight conductors, said first long straight conductors being disposed in a first common plane to form a first coil side, said second long conductors being disposed in a second common plane to form a second coil side;

first and second concrete support beams, for association with said first and second coil sides respectively, said first and second concrete support beams dimensioned for operative engagement along a substantial length of each conductor of the respective first and second coil sides, and, means for rigidly securing said first and second support beams directly to said long straight conductors said securing means including a vibrationally stiff bonding material causing said beams and said conductors to vibrate substantially in unison in response to electromagnetic forces resulting from the current.

2. An induction heater as claimed in claim 1 wherein said means includes a coil bonding material interposed between said long straight conductors and said support beams to secure the conductors to the support beams.

3. An induction heater as claimed in claim 2 wherein said coil bonding material has a modulus of elasticity in excess of 100,000 PSI.

4. An induction heater as claimed in claim 2 wherein said coil bonding material is disposed in a generally uniform average spacing between the conductors and the support beams.

5. An induction heater as claimed in claim 4 wherein said means further includes a plurality of spacers disposed intermediate the conductors and the support beams to define said generally uniform average spacing.

6. An induction heater as claimed in claim 1 including tensioning means for fastening the conductors to the support beams.

7. An induction heater as claimed in claim 6 wherein said tensioning means comprises a stud and nut assembly.

8. An induction heater as claimed in claim 6 wherein said tensioning means comprises a hook and eye assembly.

9. A coil and sound reducing support combination for an induction heater coil having at least two relatively long straight conductors comprising:

concrete supports for rigid connection to said long straight conductors, said concrete supports dimensioned for operative engagement along a substantial length of each straight conductor;

a relatively vibrationally stiff bonding material adhesively secured to the conductors and the supports for securing the supports to the conductors causing said conductor and supports to vibrate substantially in unison in response to electro-magnetic forces in the coil, and;

means for spacing the supports to the conductors at a generally uniform distance whereby the mass and stiffness of the coil is effectively increased to reduce amplitude of vibration during heater operation and to reduce consequential sound generation.

10. A method of manufacture of an induction heater comprising the steps of:

forming a coil comprised of at least two coil sides, each side including a plurality of relatively long straight conductors;

forming concrete beams sized for close supporting engagement along a substantial length of said coil sides;

preparing surfaces of the long straight conductors and beams for bonding engagement;

applying a vibrationally stiff coil bonding material for adhesive bonding the material to said surfaces; and, assembling the beam to the coil sides whereby the beam is secured to the conductors for associated vibrational movement.

11. The method as described in claim 10 wherein said preparing comprises cleaning, acid etching and rinsing first and second surfaces of the beams and conductors, respectively, said surfaces being disposed for engagement to the coil supporting material.

12. The method as described in claim 10 wherein said applying comprises pre-heating the surfaces and spreading an adhesive about the surfaces of the beams, said beam surface being defined by a peripheral flange sized to contain the adhesive during a liquid state.

13. The method as described in claim 12 wherein the surfaces of the conductors are disposed to engage the adhesive for adhesive bonding thereto, said conductors being spaced a generally uniform distance from the beam.

14. The method as described in claim 12 wherein a plurality of spacers are disposed in said adhesive to define a spacing of the conductors from the beam.

15. The method as described in claim 12 wherein said assembling comprises seating the conductors to a preselected distance from the beam and curing the adhesive whereby the surfaces are adhesively bonded for vibrationally stiff connection.

16. The method as described in claim 15 wherein said seating comprises tightening down mechanical fastening means affixed to the conductors and the beams to draw the conductors to the beam to the preselected distance, said distance being defined by a plurality of spacers interposed between the conductors and the beam.

* * * * *